US011347169B2

(12) United States Patent
Saito et al.

(10) Patent No.: US 11,347,169 B2
(45) Date of Patent: May 31, 2022

(54) FIXING APPARATUS

(71) Applicant: CANON KABUSHIKI KAISHA, Tokyo (JP)

(72) Inventors: Shutaro Saito, Tokyo (JP); Keisuke Yoshida, Tokyo (JP); Atsushi Ishigami, Osaka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/209,374

(22) Filed: Mar. 23, 2021

(65) Prior Publication Data

US 2021/0302882 A1 Sep. 30, 2021

(30) Foreign Application Priority Data

Mar. 27, 2020 (JP) ..... JP2020-059008

(51) Int. Cl.
*G03G 15/20* (2006.01)

(52) U.S. Cl.
CPC ..... *G03G 15/2053* (2013.01); *G03G 15/2064* (2013.01); *G03G 2215/2032* (2013.01)

(58) Field of Classification Search
CPC ..... G03G 15/2053; G03G 15/2064; G03G 2215/2032
See application file for complete search history.

(56) References Cited

U.S. PATENT DOCUMENTS 9,244,408 B2 1/2016 Inoue et al.
9,367,006 B2 6/2016 Yoshida et al.
10,452,006 B2 10/2019 Hashimoto et al.
2005/0129432 A1* 6/2005 Sato ..... G03G 15/2064 399/329
2013/0272757 A1* 10/2013 Amano ..... G03G 15/2053 399/329
2014/0348558 A1 11/2014 Inoue et al.
2015/0139705 A1 5/2015 Furuichi et al.
2019/0294086 A1* 9/2019 Saito ..... G03G 15/2064
2020/0089147 A1* 3/2020 Hasegawa ..... G03G 15/2064

FOREIGN PATENT DOCUMENTS

JP 2014-052484 A 3/2014
JP 2014-228765 A 12/2014
JP 2015-099185 A 5/2015
JP 2015-114394 A 6/2015

* cited by examiner

*Primary Examiner* — Clayton E. LaBalle
*Assistant Examiner* — Michael A Harrison
(74) *Attorney, Agent, or Firm* — Venable LLP

(57) ABSTRACT

A fixing apparatus includes a belt, a pad member, a pressure member, a heating roller, a stretching roller, and, an outer stretching roller. The outer stretching roller disposed between the heating roller and the stretching roller and configured to press the heating roller from an outer surface of the belt and bring the belt into contact with the heating roller. In a cross section orthogonal to a rotation axis of the pressure member, a surface between the heating roller and the stretching roller of the belt in a state where the belt is pushed toward the heating roller by the outer stretching roller is located inside that of the belt in a state where the outer stretching roller is removed.

11 Claims, 9 Drawing Sheets

FIXING APPARATUS

BACKGROUND OF THE INVENTION

Field of the Invention

The present invention relates to a fixing apparatus that fixes a toner image borne by a recording material to the recording material.

Description of the Related Art

Japanese Patent Application Publication No. 2014-228765 discloses a configuration of a fixing apparatus in which a nip portion is formed between an endless fixing belt and a pressure roller that abuts against the outer circumferential surface of the fixing belt. A toner image is fixed to a recording material when the recording material passes through the nip portion while nipped and conveyed by the fixing belt and the pressure roller. In the configuration disclosed in Japanese Patent Application Publication No. 2014-228765, a pad member is disposed inside the fixing belt for forming the above-described nip portion, and the fixing belt is heated by a heating roller that stretches the fixing belt.

In recent years, it is desired to increase the productivity brought by the image forming apparatus. However, if the productivity is increased, the number of recording materials that passes through the nip portion per unit time increases. As a result, the amount of heat that is lost from the fixing belt by the recording materials also increases. For this reason, it is desired to increase the amount of heal supplied to the fixing belt. However, if the number of healers is increased, or if the power of the heaters is increased, the power consumption of the apparatus will increase. As countermeasures to this, Japanese Patent Application Publications Nos. 2014-52484 and 2015-99185 disclose a configuration in which a roller pushes the outer surface of the fixing belt inward fir increasing the contact area between the fixing belt and the healing roller to increase the amount of heat supplied from the heating roller to the fixing belt.

By the way, Japanese Patent Application Publication No. 2015-114394 discloses a configuration in which a steering roller (stretching roller) is used in addition to the healing roller and the pad member, for adjusting the position of the fixing belt in the width direction of the fixing belt. The fixing belt is stretched by and wound around the steering roller, the heating roller, and the pad member. In this configuration, in a case where a roller is disposed for increasing the contact width, that is, the contact area between the heating roller and the fixing belt, it is desired to effectively use a space over the heating roller and the stretching roller.

SUMMARY OF THE INVENTION

The present invention provides a fixing apparatus in which the space is effectively used to dispose the roller that brings the fixing belt into contact with the heating roller.

According to one aspect of the present invention, a fixing apparatus includes a belt configured to fix an image onto a recording material, a pad member configured to be in contact with an inner surface of the belt, a pressure member configured to press the pad member via the belt and rotate, the pressure member and the belt being configured to form a nip portion in cooperation with each other, the nip portion being a portion in which the recording material is nipped and conveyed, a heating roller in which a heater is disposed and which is configured to be in contact with the inner surface of the belt and stretch and heat the belt, a stretching roller configured to be in contact with the inner surface of the belt and stretch the belt, and, an outer stretching roller disposed between the heating roller and the stretching roller and configured to press the heating roller from an outer surface of the belt and bring the belt into contact with the heating roller. In a cross section orthogonal to a rotation axis of the pressure member, a surface between the heating roller and the stretching roller of the belt in a state where the belt is pushed toward the heating roller by the outer stretching roller is located inside that of the belt in a state where the outer stretching roller is removed.

Further features of the present invention will become apparent from the following description of exemplary embodiments with reference to the attached drawings.

DESCRIPTION OF THE EMBODIMENTS

First Embodiment

Figure 1:
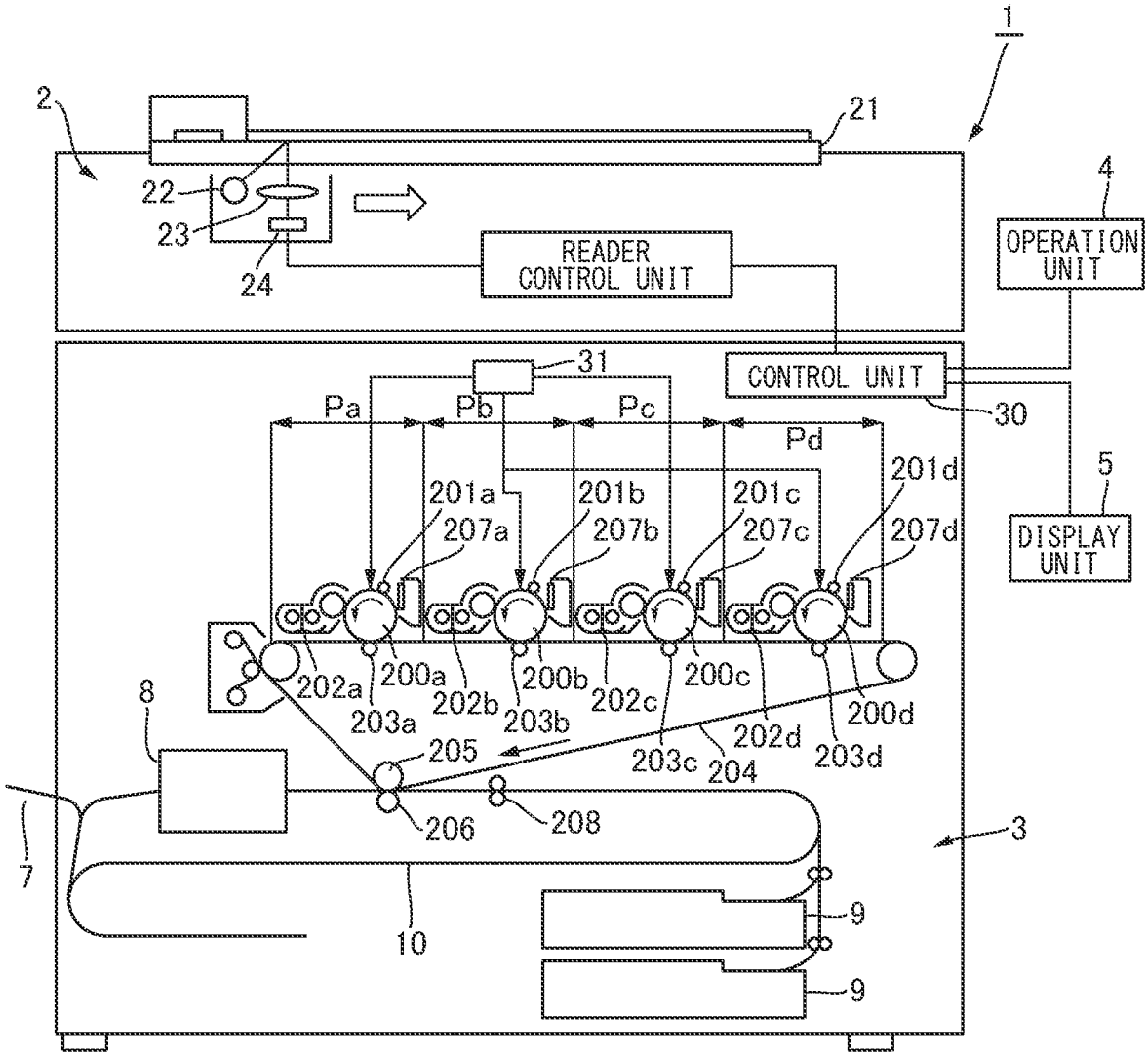
FIG. 1 is a cross-sectional view of a schematic configuration of an image forming apparatus of a first embodiment.
Figure 2:
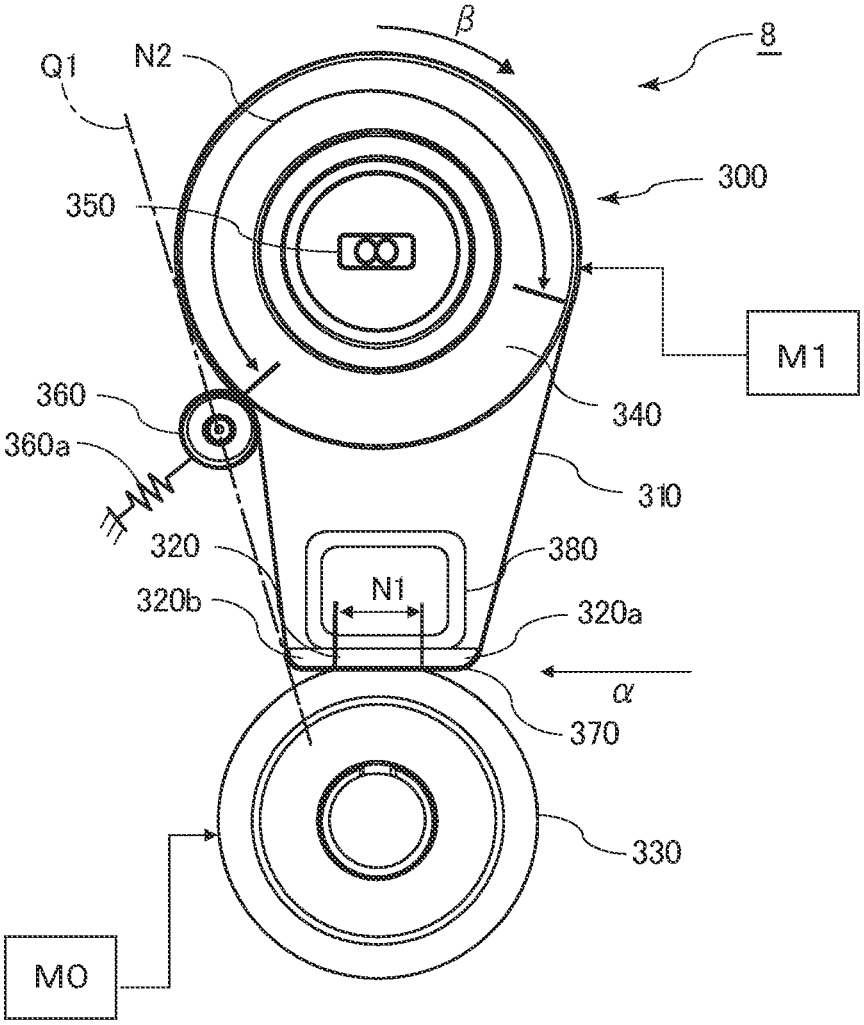
FIG. 2 is a cross-sectional view of a schematic configuration of a fixing apparatus of the first embodiment.
Figure 3:
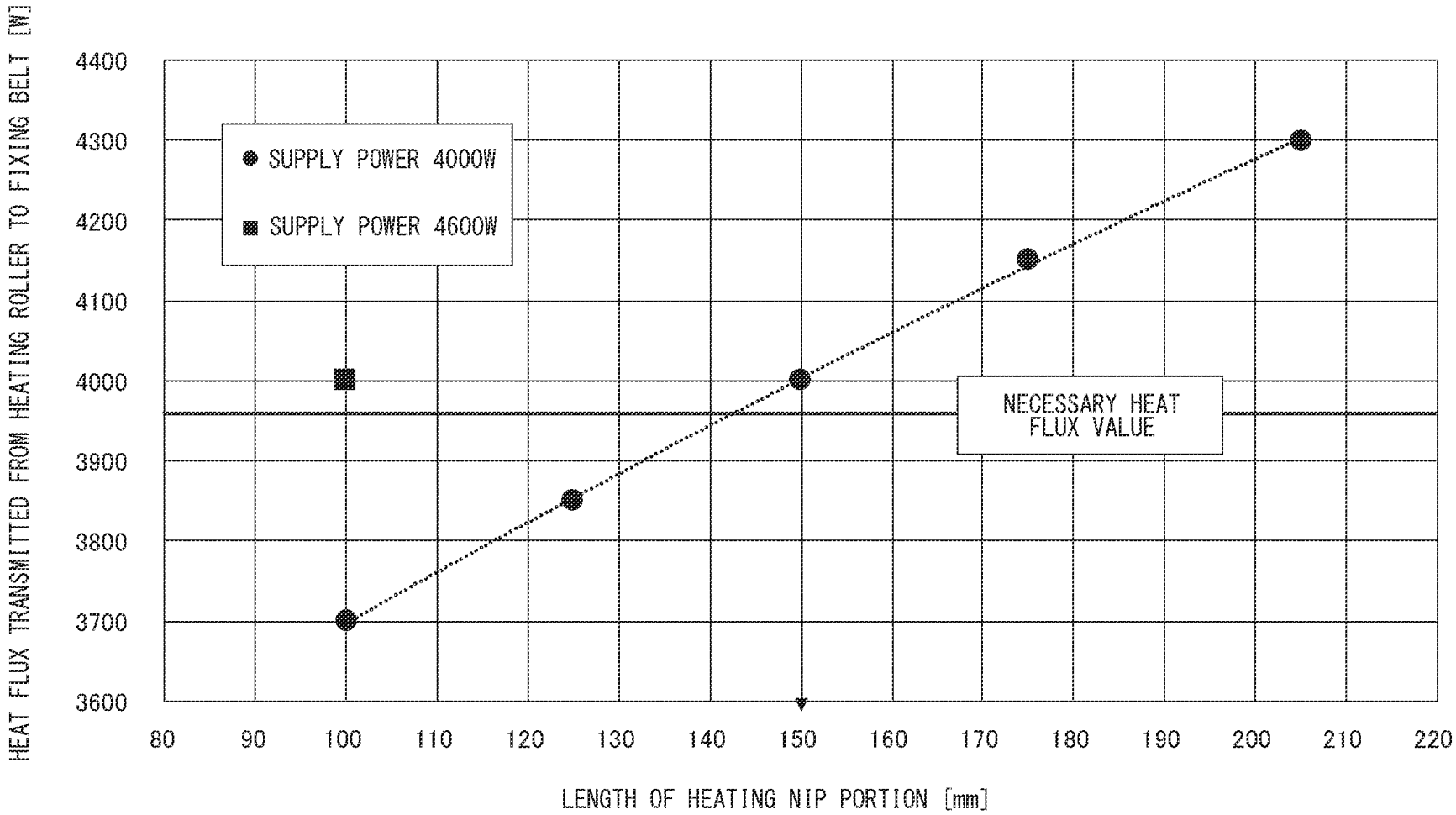
FIG. 3 is a graph illustrating a relationship between the length of a heating nip portion and the heat flux transmitted from a heating roller to a fixing belt.

A first embodiment will be described with reference to FIGS. 1 to 3. First, a schematic configuration of an image forming apparatus of the present embodiment will be described with reference to FIG. 1.

Image Forming Apparatus

An image forming apparatus 1 is an electrophotographic full-color printer that includes four image forming portions Pa, Pb, Pc, and Pd, which correspond to four colors of yellow; magenta, cyan, and black. In the present embodiment, the image forming apparatus 1 is a tandem type in which the image forming portions Pa, Pb, Pc, and Pd are disposed along a rotational direction of a later-described intermediate transfer belt 204. The image forming apparatus 1 forms a toner image (image) on a recording material, in accordance with an image signal sent from an image reading unit (document reading apparatus) 2 connected to an image forming apparatus body 3*a*, or a host device, such as a personal computer, communicatively connected with the image forming apparatus body 3. The recording material may be a sheet material, such as a paper sheet, a plastic film, or a cloth sheet.

The image forming apparatus 1 includes the image reading unit 2 and the image forming apparatus body 3. The image reading unit 2 reads a document placed on a document platen glass 21. Light emitted from a light source 22 is reflected from the document, and forms an image on a CCD sensor 24 via an optical member 23 such as a lens. Such an optical unit scans the document in a direction indicated by an arrow, and transforms the image of the document into electrical-signal data row for each line. The image signal obtained by the CCD sensor 24 is sent to the image forming apparatus body 3; and processed, as described later, by a control unit 30 for each image forming portion. Note that the control unit 30 also receives an image signal from an external host device, such as a print server.

The image forming apparatus body 3 includes the plurality of image forming portions Pa, Pb, Pc, and Pd, each of which forms an image in accordance with the above-described image signal. Specifically, the image signal is converted to a PWM (pulse width modulated) laser beam by the control unit 30. A polygon scanner 31 serves as an exposure apparatus, and performs scanning by using the laser beam in accordance with the image signal. Photosensitive drums 200*a* to 200*d* respectively serve as image bearing members of the image forming portions Pa to Pd, and are irradiated with the laser beam.

Note that the image forming portions Pa, Pb, Pc, and Pd respectively form images of yellow (Y), magenta (M), cyan (C), and black (Bk). Since the image forming portions Pa to Pd have an identical configuration, the following description will be made in detail for the image forming portion Pa used for yellow (Y), and the description for the other image forming portions will be omitted. As described below, in the image forming portion Pa, a toner image is formed on the surface of the photosensitive drum 200*a* in accordance with an image signal.

A charging roller 201*a* serves as a primary charger, and charges the surface of the photosensitive drum 200*a* at a predetermined potential for the formation of an electrostatic latent image. The electrostatic latent image is formed on the surface of the photosensitive drum 200*a* that has been charged at a predetermined potential, by the laser beam from the polygon scanner 31. A development unit 202*a* develops the electrostatic latent image formed on the photosensitive drum 200*a*, and forms a toner image. A primary transfer roller 203*a* transfers the toner image formed on the photosensitive drum 200*a* onto an intermediate transfer belt 204 by discharging electricity from a back side of the intermediate transfer belt 204 and applying a primary transfer bias to the intermediate transfer belt 204. The polarity of the primary transfer bias is opposite to the polarity of the toner. After the toner image is transferred onto the intermediate transfer belt 204, the surface of the photosensitive drum 200*a* is cleaned by a cleaner 207*a*.

One toner image formed on the intermediate transfer belt 204 is conveyed to the next image forming portion, and another toner image formed by the next image forming portion and having a corresponding color is transferred onto the one toner image formed on the intermediate transfer belt 204. In this manner, toner images having respective colors are transferred onto the intermediate transfer belt 204 sequentially in the order of Y, M, C, and Bk, so that a toner image having four colors is formed on the surface of the intermediate transfer belt 204. The toner image that has passed through the image forming portion Pd, which corresponds to a color of Bk and is located most downstream in the rotational direction of the intermediate transfer belt 204, is conveyed to a secondary transfer portion formed by a secondary-transfer roller pair 205 and 206. In the secondary transfer portion, a secondary-transfer electric field, whose polarity is opposite to the polarity of the toner image formed on the intermediate transfer belt 204, is applied to the toner image, so that the toner image is secondary-transferred onto the recording material.

The recording material is stored in a cassette 9. The recording material is fed from the cassette 9, conveyed to a registration portion 208 formed by a pair of registration rollers, and waits at the registration portion 208. Then, timing is controlled for aligning the position of the toner image formed on the intermediate transfer belt 204 with the position of the recording material, and the recording material is conveyed to the secondary transfer portion at the timing by the registration portion 208.

The recording material onto which the toner image has been transferred in the secondary transfer portion is conveyed to a fixing apparatus 8. In the fixing apparatus 8, the recording material is heated and pressed so that the toner image borne by the recording material is fixed to the recording material. The recording material having passed through the fixing apparatus 8 is discharged to a discharging tray 7. In a case where images are formed on both sides of the recording material, after a toner image is transferred and fixed to a first side (front side) of the recording material, the recording material is conveyed to a reverse-and-conveyance portion 10, and reversed. Then, another toner image is transferred and fixed to a second side (back side) of the recording material, and the recording material is stacked on the discharging tray 7.

The control unit 30 controls the whole of the image forming apparatus 1, as described above. In addition, the control unit 30 can perform various types of setting in accordance with input data, which is inputted through an operation unit 4 or a display unit 5 of the image forming apparatus 1. The operation unit 4 and the display unit 5 are included in the image forming apparatus 1, and may include a touch panel and buttons. The touch panel allows a user to perform touch operation.

The control unit 30 includes a central processing unit (CPU), a read only memory (ROM), and a random access memory (RAM). The CPU reads a program stored in the ROM and corresponding to a control procedure, and controls each component. The RAM stores work data and input data. The CPU refers to the data stored in the RAM, depending on the above-described program; and controls each component.

Fixing Apparatus

Next, a configuration of the fixing apparatus 8 of the present embodiment will be described with reference to FIG. 2. In the present embodiment, the fixing apparatus 8 is a belt-heating fixing apparatus that uses an endless belt. In FIG. 2, the recording material is conveyed from right to left, as indicated by an arrow $\alpha$. The fixing apparatus 8 includes a heating unit 300 and a pressure roller 330. The heating unit 300 includes an endless fixing belt 310 that can rotate. The pressure roller 330 serves as a pressure member, and abuts against the fixing belt 310. Thus, the pressure roller 330 and the fixing belt 310 form a nip portion (fixing nip portion) N1.

The heating unit 300 includes the above-described fixing belt 310, a fixing pad 320 that serves as a pad member, a heating roller 340 that serves as a rotary heating member, and an outer stretching roller 360 that serves as an outer roller. The fixing belt 310 is stretched by and wound around the fixing pad 320 and the heating roller 340, which are stretching members. The pressure roller 330, which serves as a rotary driving member, serves also as a driving roller that abuts against the outer circumferential surface of the fixing belt 310 and rotates, and that provides driving force to rotate the fixing belt 310, to the fixing belt 310.

The endless fixing belt 310 has thermal conductivity and thermal resistance, and is formed like a hollow thin cylinder that has an inner diameter of 120 mm for example. In the present embodiment, the fixing belt 310 has a three-layer structure in which a base layer, an elastic layer, and a release layer are formed. The elastic layer is formed on the outer circumferential surface of the base layer, and the release layer is formed on the outer circumferential surface of the elastic layer. The base layer has a thickness of 60 μm, and is made of polyimide resin (PI). The elastic layer has a thickness of 300 μm, and is made of silicone rubber. The release layer has a thickness of 30 μm, and is made of PFA (tetrafluoroethylene-perfluoroalkoxy ethylene copolymer) that is a fluororesin. The fixing belt 310 is stretched by and wound around the fixing pad 320 and the heating roller 340. In addition, the fixing belt 310 is driven and rotated by the later-described pressure roller 330 and the heating roller 340 in a direction indicated by an arrow β.

The fixing pad 320 serves as a pad member, and is disposed inside the fixing belt 310 so as to face the pressure roller 330 via the fixing belt 310. The fixing pad 320 forms the nip portion N1 in which the recording material is conveyed while nipped between the fixing belt 310 and the pressure roller 330. In the present embodiment, the fixing pad 320 is a member formed like a long plate that extends in the width direction of the fixing belt 310 (longitudinal direction that crosses the rotational direction of the fixing belt 310, or rotation-axis direction of the heating roller 340). The fixing pad 320 is pressed by the pressure roller 330 via the fixing belt 310, so that the nip portion N1 is formed. The material of the fixing pad 320 is a liquid crystal polymer (LCP) resin.

A portion of the fixing pad 320 forms the nip portion N1, and at least one portion of the portion of the fixing pad 320 is made flat. That is, one portion of the fixing pad 320 that is in contact with the inner circumferential surface of the fixing belt 310 via a later-described lubricating sheet 370 is made nearly flat, making the nip portion nearly flat. With this configuration, especially when a toner image is fixed to an envelope that is a recording material, creases and shift in image position can be suppressed from occurring in the envelope.

In the present embodiment, both edge portions of the fixing pad 320 in the recording-material conveyance direction in the nip portion N1 are curved shape portions 320*a* and 320*b*. The curved shape portion 320*a* is curved toward a direction (upward direction in FIG. 2) extending away from a nip plane toward one edge portion, and the curved shape portion 320*b* is curved toward a direction (upward direction in FIG. 2) extending away from the nip plane toward the other edge portion. The nip plane is formed between the fixing belt 310 and the pressure roller 330, along a surface of the fixing pad 320 on the pressure roller 330 side (i.e., lower surface of the fixing pad 320 in FIG. 2).

Thus, in the present embodiment, the curved shape portion 320*b* is a downstream edge portion of the fixing pad 320, and the fixing belt 310 is curved in accordance with a curvature of the curved shape portion 320*b*. In addition, the recording material that has passed through the nip portion N1 is separated from the fixing belt 310 by the curvature of the fixing belt 310. In the present embodiment, the curved shape portion 320*a* of the fixing pad 320 formed upstream of the nip portion N1 has a radius of curvature of 8 mm, and the curved shape portion 320*b* of the fixing pad 320 formed downstream of the nip portion N1 has a radius of curvature of 6 mm.

The fixing pad 320 is supported by a stay 380, which serves as a supporting member disposed inside the fixing belt 310. That is, the stay 380 is disposed opposite to the pressure roller 330 with respect to the fixing pad 320, and supports the fixing pad 320. The stay 380 is a long rigid reinforcing member that extends along the longitudinal direction of the fixing belt 310, and abuts against the fixing pad 320 and backs up the fixing pad 320. That is, when the fixing pad 320 is pressed by the pressure roller 330, the stay 380 allows the fixing pad 320 to have strength, and ensures the pressure applied in the nip portion N1. The stay 380 is fixed to a fixing frame (not illustrated) and positioned by the same.

The stay 380 is made of metal such as stainless steel or iron, and has an almost rectangular cross section (transverse cross section) that is orthogonal to the longitudinal direction of the stay 380, which crosses the rotational direction of the fixing belt 310. For ensuring the strength of the stay 380, a material used in drawing process, made of SUS304 (stainless steel), and having a thickness of 3 mm may be used for forming the stay 380 whose transverse cross section is shaped like a hollow square. Note that the stay 380 may be formed by combining a plurality of metal plates and fixing them to each other through welding or the like such that the cross section becomes almost rectangular. In addition, the material of the stay 380 may not be stainless steel as long as the strength of the stay 380 is ensured.

The lubricating sheet 370 is interposed between the fixing pad 320 and the fixing belt 310. In the present embodiment, the lubricating sheet 370 is a PI (polyimide) sheet coated with PTFE (polytetrafluoroethylene), and the thickness of the lubricating sheet 370 is 100 μm. On the PI sheet, projections having a height of 100 μm are formed at intervals of 1 mm for reducing the contact area between the lubricating sheet 370 and the fixing belt 310 to reduce the slide resistance.

In addition, lubricant is applied on the inner circumferential surface of the fixing belt 310 for allowing the fixing belt 310 to smoothly slide with respect to the fixing pad 320 covered by the lubricating sheet 370. The lubricant used is silicone oil having a viscosity of 100 cSt.

The heating roller 340 is disposed inside the fixing belt 310, and the heating roller 340 and the fixing pad 320 stretch the fixing belt 310. Since the inner circumferential surface of the fixing belt 310 is applied with the lubricant as described above, the heating roller 340 stretches the fixing belt 310 via the lubricant. The heating roller 340 is made of metal such as aluminum or stainless steel, and formed like a cylinder. Inside the heating roller 340, a halogen heater 350 is disposed, as a heating unit, for heating the fixing belt 310. Thus, the heating roller 340 is heated up to a predetermined temperature by the halogen heater 350.

In the present embodiment, the healing roller 340 is an aluminum pipe having an outer diameter of 80 mm and a thickness of 1 mm for example, in consideration of thermal conductivity. The halogen heater 350 may be one in number, but a plurality of halogen heaters is preferably disposed for controlling the temperature distribution of the heating roller 340 in the longitudinal direction (rotation-axis direction) of the heating roller 340. The fixing belt 310 is heated by the heating roller 340 heated by the halogen heater 350; and is controlled, depending on a temperature detected by a thermistor (not illustrated), so as to have a predetermined target temperature in accordance with a type of the recording material.

Note that the heating unit may not be the halogen healer; and may be another heater, such as a carbon heater, that can heat the heating roller 340. In another case, the heating unit may heat the heating roller 340 through induction heating (IH). For example, a coil may be disposed outside the heating roller 340 and the fixing belt 310, and the fixing belt 310 and the heating roller 340 may be heated through induction heating.

The heating roller 340 has a gear fixed to one end portion of the heating roller 340 in the rotation-axis direction, and is coupled with a motor M1 via the gear. Thus, the heating roller 340 is rotated by the motor M1, which serves as a heating-roller driving source. The driving force for the fixing belt 310 is provided by the rotation of the heating roller 340. The force provided from the heating roller 340 to the fixing belt 310 is assistance driving force. Note that the heating roller 340 may be coupled with a later-described motor M0 that serves as a pressure-roller driving source, and may be rotated by the motor M0. In addition, the mechanism to transmit the driving force from the motor may be another mechanism other than the gear. For example, the mechanism may be a pulley and a belt, or may be a mechanism that presses a roller driven by a motor, against the outer surface of the heating roller 340. Preferably, the circumferential speed of the heating roller is higher than the circumferential speed of the pressure roller 330.

The pressure roller 330 serves as a pressure member, and serves also as a rotary driving member (that is a driving roller in the present embodiment) that abuts against the outer circumferential surface of the fixing belt 310 and rotates, and that provides driving force to the fixing belt 310. In the present embodiment, the pressure roller 330 is a roller including a shaft, an elastic layer formed on the outer circumferential surface of the shaft, and a release layer formed on the outer circumferential surface of the elastic layer. The shaft is made of stainless steel. The elastic layer has a thickness of 5 mm, and is made of conductive silicone rubber. The release layer has a thickness of 50 μm, and is made of PFA (tetrafluoroethylene-perfluoroalkoxy ethylene copolymer) that is a fluororesin. The pressure roller 330 is rotatably supported by a fixing frame (not illustrated) of the fixing apparatus 8. In addition, the pressure roller 330 has a gear fixed to one end portion of the pressure roller 330, and is coupled with the motor M0 via the gear. Thus, the pressure roller 330 is rotated by the motor M0, which serves as a pressure-roller driving source.

An outer stretching roller 360 abuts against the outer circumferential surface of the fixing belt 310 at an upstream edge of an area in which the fixing belt 310 abuts against the heating roller 340. The upstream edge is an edge of the area located upstream in the rotational direction (indicated by an arrow β) of the fixing belt 310. In this arrangement, the fixing belt 310 is positioned closer to the heating roller (rotary heating member) 340 than the fixing belt 310 that would be stretched between the heating roller 340 and the fixing pad 320 if the outer stretching roller 360 were not disposed. The fixing pad 320 is a predetermined one of the plurality of stretching members, and is located upstream of the heating roller 340 in the rotational direction of the fixing belt 310.

In other words, the fixing belt 310 is nipped by the outer stretching roller 360 and the heating roller 340 at the upstream edge of the area in which the fixing belt 310 abuts against the heating roller 340. The upstream edge is an edge of the area located upstream in the rotational direction of the fixing belt 310. In addition, the outer stretching roller 360 is positioned at a position at which the outer stretching roller 360 pushes the fixing belt 310 toward the heating roller 340. That is, the outer stretching roller 360 is positioned at a position at which the outer stretching roller 360 pushes the fixing belt 310 from a tangent Q1 of the heating roller 340 toward the heating roller 340. The tangent Q1 of the heating roller 340 is a line that touches the downstream edge of the fixing pad 320 located in the conveyance direction. The area in which the fixing belt 310 abuts against the heating roller 340 is a heating nip portion N2.

The outer stretching roller 360 is urged toward the heating roller 340 by a pressure spring 360*a*, which serves as an urging member. The pressure spring 360*a* is supported by a fixing frame (not illustrated), and urges the outer stretching roller 360 from the outside of the fixing belt 310 toward the heating roller 340 so that the outer stretching roller 360 abuts against the fixing belt 310. That is, the outer stretching roller 360 presses the heating roller 340 via the fixing belt 310. In the present embodiment, the outer stretching roller 360 is disposed such that the length of the heating nip portion N2 is changed from 100 to 150 mm when the outer stretching roller 360 abuts against the fixing belt 310. Note that the length of the healing nip portion N2 is a length measured in the rotational direction of the fixing belt 310.

In the present embodiment, the outer stretching roller 360 is a metal roller, and may be a cylindrical member having a diameter of 20 mm. In addition, the outer stretching roller 360 is made of a stainless steel (such as SUS303) having high rigidity for suppressing deflection of the outer stretching roller 360 and producing substantially uniform abutment pressure. The outer stretching roller 360 abuts against the fixing belt 310 in a direction extending from a position located upstream of the heating roller 340 in the rotational direction of the fixing belt 310, toward the heating roller 340, for moving the fixing belt 310 along the curved shape portion 320*b* of the fixing pad 320. In addition, the outer stretching roller 360 is urged by the pressure spring 360*a* from the outside of the fixing belt 310 toward the heating roller 340, with a total pressure of 100 N; and is rotated by the rotation of the fixing belt 310.

The fixing apparatus 8 configured as described above heats a toner image in the nip portion N1 formed between the fixing belt 310 and the pressure roller 330, while causing the fixing belt 310 and the pressure roller 330 to nip and convey the recording material that bears the toner image. With this operation, the toner image is melted and fixed to the recording material. In the present embodiment, in the image formation, the circumferential speed of the fixing belt 310 is 300 mm/s, the pressure applied in the nip portion N1 is 1000 N, and the temperature of the fixing belt 310 is 180° C.

In the present embodiment, as described above, the outer stretching roller 360 is disposed at the upstream edge of the heating nip portion N2 in the rotational direction of the fixing belt 310, for increasing the area of the heating nip portion N2 with respect to the area of the heating nip portion N2 obtained when the outer stretching roller 360 is not disposed. That is, the outer stretching roller 360 increases the contact area between the fixing belt 310 and the heating roller 340. Thus, the amount of heat supplied from the heating roller 340 to the fixing, belt 310 can be increased without increasing the power anti the number of heaters. That is, the amount of heat supplied to the fixing belt 310 can be secured while the power consumption is suppressed.

In addition, increasing the area of the heating nip portion N2 does not need increasing the outer diameter of the heating roller 340 and the heating roller 340 in number. Thus, the configuration of the present embodiment is hardly affected by the space in which the fixing apparatus is disposed. That is, since the area of the heating nip portion N2 is increased in this configuration by the outer stretching roller 360 abutting against the outer circumferential surface of the fixing belt 310, the outer stretching roller 360 hardly interferes with other components in the space in which the fixing apparatus is disposed, and the arrangement of the outer stretching roller 360 is hardly affected by the space in which the fixing apparatus is disposed.

Effect of Increasing Heating Nip Portion

Next, an effect of increasing the heating nip portion N2 will be described with reference to FIG. 3. FIG. 3 is a graph illustrating a relationship between the length of the heating nip portion N2 and the heat flux transmitted from the heating roller 340 to the fixing belt 310. In FIG. 3, as the length of the heating nip portion N2 increases, the heat flux transmitted from the heating roller 340 to the fixing belt 310 also increases. For example, assume that the heat flux transmitted from the heating roller 340 to the fixing belt 310 is required to have a value of 3950 W for keeping the temperature of the fixing belt 310 co slant and allowing high-speed operation of the image forming apparatus. In this case, in the configuration in which the outer stretching roller 360 does not abut against the fixing belt 310 (the length of the heating nip portion N2 is 100 mm), it is necessary to increase the electric power supplied to the apparatus, from 4000 W to 4600 W for achieving the heat flux of 3950 W or more, as illustrated in FIG. 3. In contrast, in the configuration of the present embodiment in which the outer stretching roller 360 abuts against the fixing belt 310, if the outer stretching roller 360 is disposed such that the length of the heating nip portion N2 is 150 mm, it is possible to keep the electric power supplied to the apparatus, at 4000 W for achieving the heat flux of 3950 W or more, as illustrated in FIG. 3. That is, the amount of heat supplied to the fixing belt 310 can be secured while the power consumption is suppressed.

Second Embodiment

Figure 4:
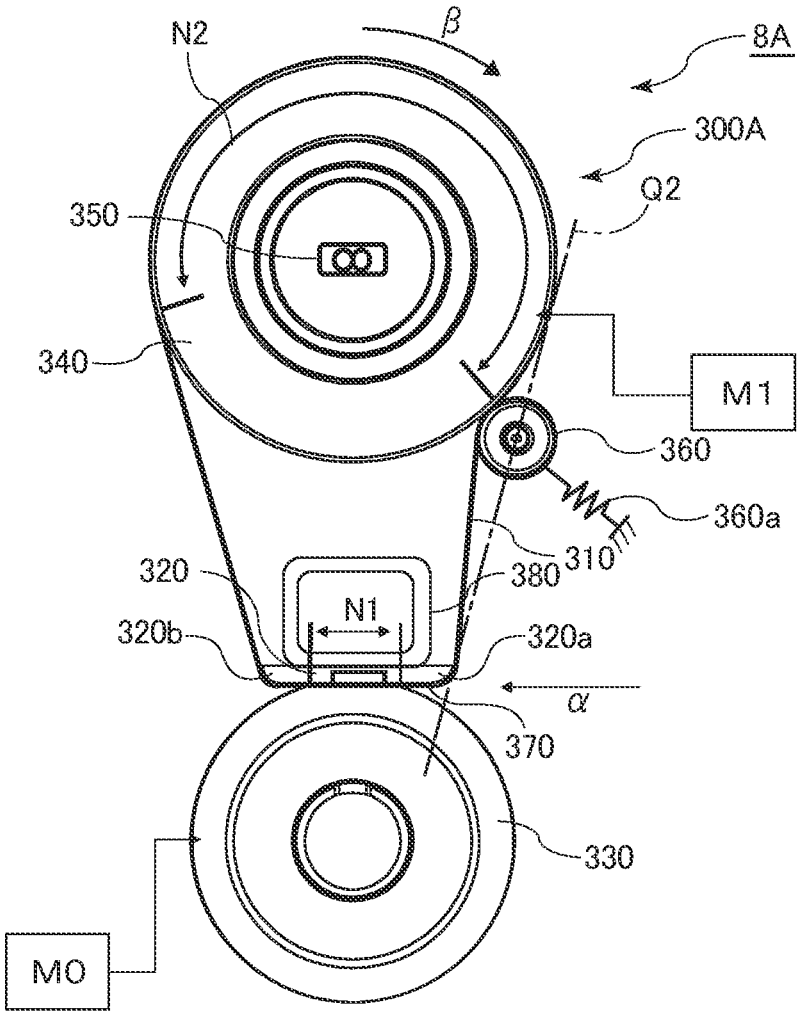
FIG. 4 is a cross-sectional view of a schematic configuration of a fixing apparatus of a second embodiment.

Next, a second embodiment will be described with reference to FIG. 4. In the above-described first embodiment, the outer stretching roller 360 is disposed at the upstream edge of the heating nip portion N2. In the present embodiment, however, the outer stretching roller 360 is disposed at the downstream edge of the heating nip portion N2. The other configuration and operations are the same as those of the above-described first embodiment. Thus, a component identical to a component of the first embodiment is given an identical symbol, and duplicated description and illustration will be omitted or simplified, and features different from the first embodiment will be mainly described below.

In a heating unit 300A of a fixing apparatus 8A of the present embodiment, the outer stretching roller 360 is disposed downstream of the heating roller 340 in the rotational direction of the fixing belt 310. That is, the outer stretching roller 360 abuts against the outer circumferential surface of the fixing belt 310 at a downstream edge of an area in which the fixing belt 310 abuts against the heating roller 340. The downstream edge is an edge of the area located downstream in the rotational direction (indicated by an arrow β) of the fixing belt 310. In this arrangement, the fixing belt 310 is positioned closer to the heating roller (rotary heating member) 340 than the fixing belt 310 that would be stretched between the heating roller 340 and the fixing pad 320 if the outer stretching roller 360 were not disposed. The fixing pad 320 is a predetermined one of the plurality of stretching members, and located downstream of the heating roller 340 in the rotational direction of the fixing belt 310.

In other words, the fixing belt 310 is nipped by the outer stretching roller 360 and the heating roller 340 at the downstream edge of the area in which the fixing belt 310 abuts against the heating roller 340. The downstream edge is an edge of the area located downstream in the rotational direction of the fixing belt 310. In addition, the outer stretching roller 360 is positioned at a position at which the outer stretching roller 360 pushes the fixing belt 310 toward the heating roller 340. That is, the outer stretching roller 360 is positioned at a position at which the outer stretching roller 360 pushes the fixing belt 310 from a tangent Q2 of the heating roller 340 toward the heating roller 340. The tangent Q2 of the heating roller 340 is a line that touches the upstream edge of the fixing pad 320 located in the conveyance direction. The area in which the fixing belt 310 abuts against the heating roller 340 is a heating nip portion N2.

Also in the present embodiment, the outer stretching roller 360 is urged toward the heating roller 340 by the pressure spring 360*a*, which serves as an urging member. The outer stretching roller 360 abuts against the fixing belt 310 in a direction extending from a position located downstream of the heating roller 340 in the rotational direction of the fixing belt 310, toward the heating roller 340, for moving the fixing belt 310 along the curved shape portion 320*a* of the fixing pad 320.

In the present embodiment, as described above, the outer stretching roller 360 is disposed at the downstream edge of the heating nip portion N2 in the rotational direction of the fixing belt 310, for increasing the area of the heating nip portion N2 with respect to the area of the heating nip portion N2 obtained when the outer stretching roller 360 is not disposed. Thus, as in the first embodiment, the amount of heat supplied to the fixing belt 310 can be secured while the power consumption is suppressed. In addition, the configuration of the present embodiment is hardly affected by the space in which the fixing apparatus is disposed. Note that although the single outer stretching roller 360 is disposed at the upstream edge or the downstream edge of the heating nip portion N2 in the first and the second embodiments, two outer stretching rollers 360 may be used, and one may abut against the heating roller 340 at the upstream edge of the heating nip portion N2 in the rotational direction and the other may abut against the heating roller 340 at the downstream edge of the heating nip portion N2 in the rotational direction.

Third Embodiment

Next, a third embodiment will be described with reference to FIGS. 5 to 8. In the present embodiment, a steering roller 410 and a cleaning apparatus 610 are disposed. The steering roller 410 controls the position (deviation) of the fixing belt 310 in the longitudinal direction of the fixing belt 310. The cleaning apparatus 610 cleans the outer stretching roller 360. The other configuration and operations are the same as those of the above-described second embodiment. Thus, a component identical to a component of the second embodiment is given an identical symbol, and duplicated description and illustration will be omitted or simplified, and features different from the second embodiment will be mainly described below.

Figure 5:
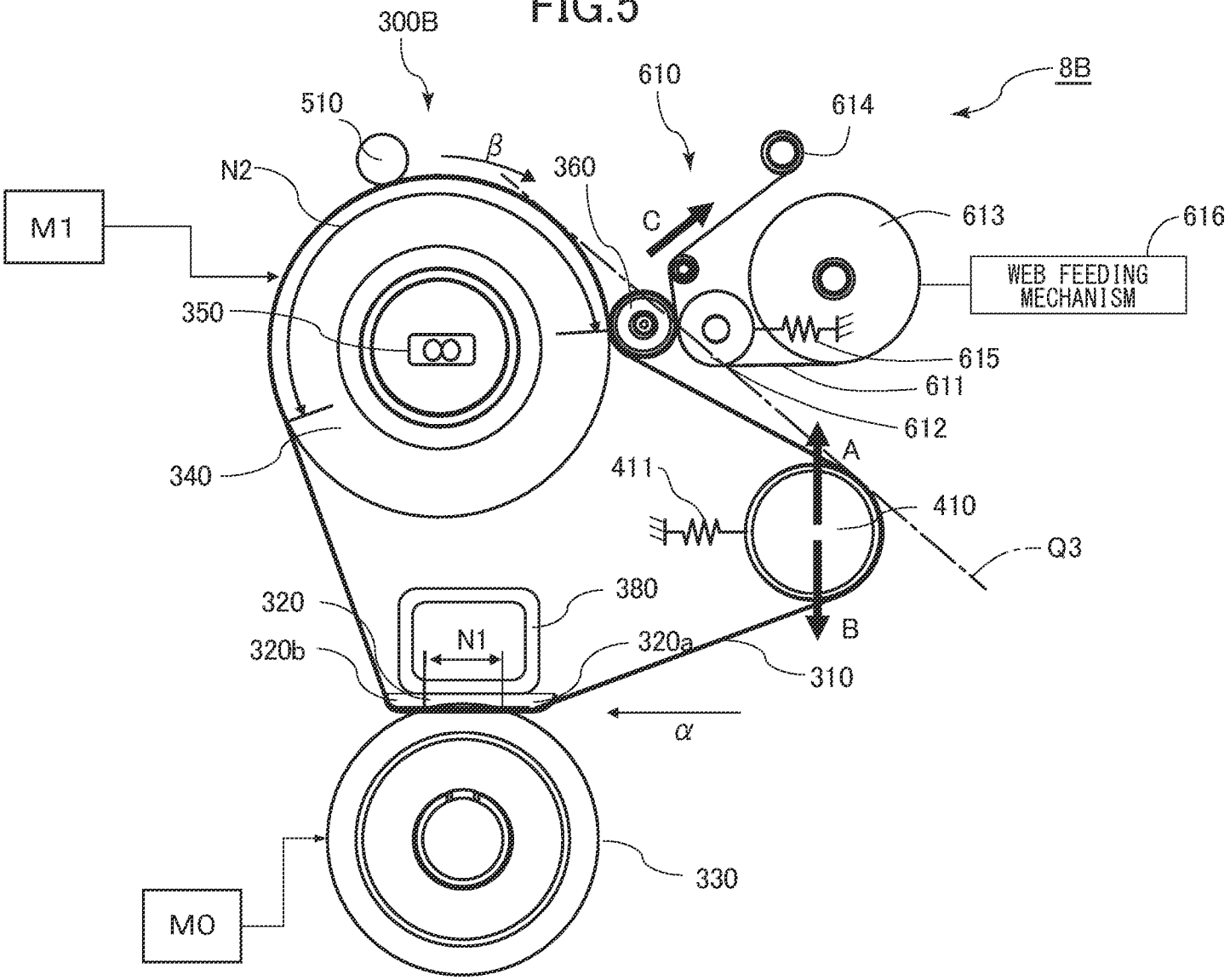
FIG. 5 is a cross-sectional view of a schematic configuration of a fixing apparatus of a third embodiment.

As illustrated in FIG. 5, a heating unit 300B of a fixing apparatus 8B of the present embodiment includes the steering roller 410 and the cleaning apparatus 610. In addition, in the present embodiment a refreshing roller 510 is disposed so as to abut against the outer circumferential surface of the fixing belt 310. The fixing belt 310 is stretched by and wound around the heating roller 340, the fixing pad 320, and the steering roller 410, which are stretching members. The steering roller 410 is a stretching roller disposed downstream of the heating roller 340 and upstream of the fixing pad 320 in the rotational direction (indicated by an arrow β) of the fixing belt 310. In addition, the steering roller 410 is disposed inside the fixing belt 310. In other words, the heating roller 340 is disposed downstream of the fixing pad 320 and upstream of the steering roller 410 in the rotational direction of the fixing belt 310. In the present embodiment, the inner diameter of the fixing belt 310 is 180 mm. In the present embodiment, the rotation center of the heating roller 340 is separated more from the nip portion N1 than the rotation center of the steering roller 410 in a direction orthogonal to the conveyance direction of the recording material. Specifically, the rotation center of the heating roller 340 is located above the rotation center of the steering roller 410, in the vertical direction.

Also in the present embodiment, the outer stretching roller 360 is disposed downstream of the heating roller 340 in the rotational direction of the fixing belt 310. That is, the outer stretching roller 360 abuts against the outer circumferential surface of the fixing belt 310 at the downstream edge of an area in which the fixing belt 310 abuts against the heating roller 340. The downstream edge is an edge of the area located downstream in the rotational direction of the fixing belt 310. In this arrangement, the fixing belt 310 is positioned closer to the heating roller 340 than the fixing belt 310 that would be stretched between the heating roller 340 and the steering roller 410 if the outer stretching roller 360 were not disposed. The steering roller 410 is a predetermined one of the plurality of stretching members, and located downstream of the heating roller 340 in the rotational direction of the fixing belt 310. Thus, the steering roller 410 is disposed downstream of the outer stretching roller 360 and upstream of the nip portion N1 in the rotational direction of the fixing belt 310. In the present embodiment, the outer stretching roller 360 is disposed between the heating roller 340 and the steering roller 410. That is, the outer stretching roller 360 is disposed between the rotation center of the heating roller 340 and the rotation center of the steering roller 410.

In addition, the fixing belt 310 is nipped by the outer stretching roller 360 and the heating roller 340 at the downstream edge of the area in which the fixing belt 310 abuts against the heating roller 340. The downstream edge is an edge of the area located downstream in the rotational direction of the fixing belt 310. In addition, the outer stretching roller 360 is positioned at a position at which the outer stretching roller 360 pushes the fixing belt 310 toward the heating roller 340. That is, the outer stretching roller 360 is positioned at a position at which the outer stretching roller 360 pushes the fixing belt 310 from a common tangent Q3 of the heating roller 340 and the steering roller 410, toward the heating roller 340. The common tangent Q3 of the heating roller 340 and the steering roller 410 is a line on the outer stretching roller 360 side. The line Q3 is a surface between the heating roller 340 and the steering roller 410 of the fixing belt 310 in a state where the outer stretching roller 360 is removed. That is, in the cross-sectional view of FIG. 5 that is orthogonal to the rotation axis of the pressure roller 330, the fixing belt 310 pushed by the outer stretching roller 360 is located inside the line Q3. Furthermore, in the present embodiment, a surface of the fixing belt 310 pushed by the outer stretching roller 360 is located inside the surface of the fixing belt 310 formed when the outer stretching roller 360 is removed and the steering roller 410 slants at its maximum angle. The area in which the fixing belt 310 abuts against the heating roller 340 is a heating nip portion N2.

Next, the steering roller 410 will be described in detail. The steering roller 410 is disposed inside the fixing belt 310, and the fixing belt 310 is stretched by and wound around the steering roller 410, the fixing pad 320, and the heating roller 340. The steering roller 410 is rotated by the rotation of the fixing belt 310. The steering roller 410 slants with respect to the rotation-axis direction (longitudinal direction) of the heating roller 340, and thereby controls (adjusts) the position (deviation position, or position in the width direction) of the fixing belt 310 in the rotation-axis direction. Specifically, the steering roller 410 has a pivot center positioned at the center of the steering roller 410 in the rotation-axis direction (longitudinal direction of the steering roller 410), and swings on the pivot center. In this manner, the steering roller 410 slants with respect to the longitudinal direction of the heating roller 340. As a result, the steering roller 410 produces difference in tension between one end portion and the other end portion of the fixing belt 310 in the longitudinal direction of the fixing belt 310, and thereby moves the fixing belt 310 in the longitudinal direction of the fixing belt 310.

For example, if one end portion (hereinafter referred to as a front end portion) of the steering roller 410 in the longitudinal direction moves toward a direction indicated by an arrow A of FIG. 5, the other end portion (hereinafter referred to as a back end portion) of the steering roller 410 in the longitudinal direction moves toward a direction indicated by an arrow B of FIG. 5. As a result, the fixing belt 310 moves from the back end portion toward the front end portion in the longitudinal direction. In contrast, if the front end portion of the steering roller 410 moves toward the direction indicated by the arrow B of FIG. 5, the back end portion of the steering roller 410 moves toward the direction indicated by the arrow A of FIG. 5, and the fixing belt 310 moves from the front end portion toward the back end portion in the longitudinal direction. Thus, the position of the fixing belt 310 in the longitudinal direction can be within a predetermined range by changing the position of the steering roller 410 in accordance with a position of the fixing belt 310 in the longitudinal direction.

Note that the steering roller 410 may be swung by a driving source such as a motor, or by self-aligning. In addition, the pivot center may be positioned, as in the present embodiment, at the center of the steering roller 410 in the longitudinal direction, or may be positioned at an end portion of the steering roller 410 in the longitudinal direction. If the steering roller 410 is swung by using a motor, it is preferable to control the amount of swing in accordance with a detection result of a sensor that detects the position of an end portion of the fixing belt 310.

In addition, in the present embodiment, the steering roller 410 serves also as a tension roller that is urged by a spring 411, which is supported by a frame of the heating unit 300B and serves as an urging member, and that provides predetermined tension to the fixing belt 310. In the present embodiment, the tension provided by the spring 411 is 40 N. Since the tension is provided to the fixing belt 310 by the steering roller 410 in this manner, the fixing belt 310 moves along the curved shape portions 320*a* and 320*b* of the fixing pad 320. That is, the fixing belt 310 is curved along the curved shape portions 320*a* and 320*b*.

The steering roller 410 is made of metal such as aluminum or stainless steel, and formed like a cylinder. In the present embodiment, the steering roller 410 is a cylindrical member made of SUS303 and having an outer diameter of 40 mm and a thickness of 1 mm, and one end portion of the steering roller 410 is rotatably supported by a bearing (not illustrated). Note that another stretching roller having no steering function may be disposed at the position of the steering roller 410, instead of the steering roller 410. For example, the stretching roller may be a tension roller that provides tension to the fixing belt 310, or may be a stretching roller that moves to change the trajectory of the fixing belt 310 in accordance with a type of the recording material. In short, the present embodiment can be preferably applied as long as the stretching roller can move in the direction that crosses the rotation-axis direction, and can change the posture of the fixing belt 310. The stretching roller may not move, and may simply stretch the fixing belt 310. In this case, in the cross-sectional view of FIG. 5 that is orthogonal to the rotation axis of the pressure roller 330, the line Q3 (FIG. 5) is a surface between the heating roller 340 and the stretching roller (in place of the steering roller 410) of the fixing belt 310 in a state where the outer stretching roller 360 is removed, and the fixing belt 310 pushed by the outer stretching roller 360 is located inside the line Q3.

Figure 6:
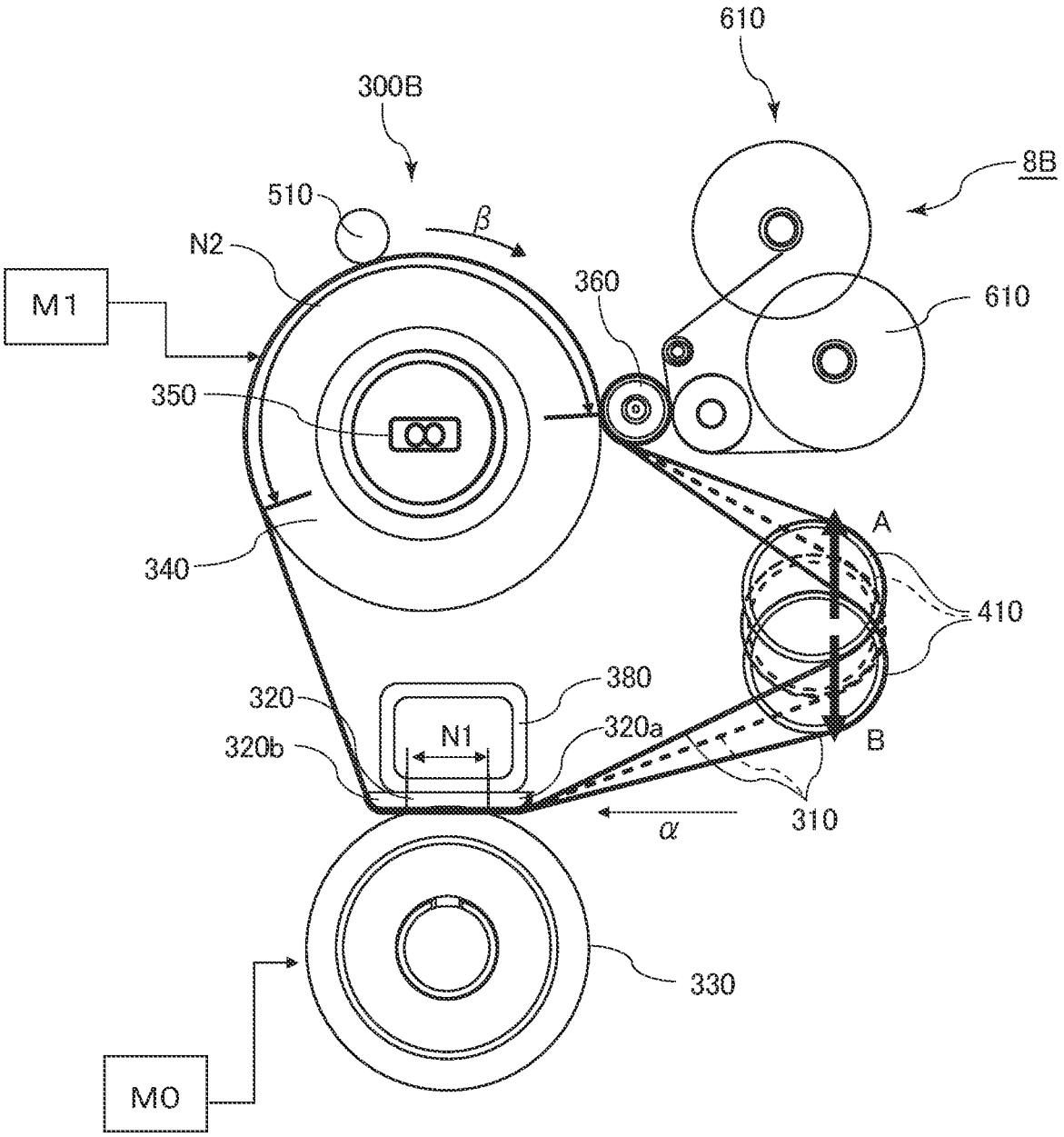
FIG. 6 is a cross-sectional view of a schematic configuration of the fixing apparatus of the third embodiment that illustrates behavior of a fixing belt exhibited when steering is performed.

FIG. 6 illustrates the change in trajectory of one end portion of the fixing belt 310, obtained when the steering roller 410 is steered in a direction indicated by an arrow A and in a direction indicated by an arrow B (the one end portion is located in the longitudinal direction of the fixing belt 310). When the steering roller 410 is steered, the posture of the fixing belt 310 changes in a section ranging from a position located downstream of the heating nip portion N2 in the rotational direction of the fixing belt 310, to a position located upstream of the nip portion N1 in the rotational direction of the fixing belt 310. In contrast, the posture of the fixing belt 310 hardly changes and is stable in a section ranging from a position located downstream of the nip portion N1 in the rotational direction of the fixing belt 310, to a position located upstream of the heating nip portion N2 in the rotational direction of the fixing belt 310.

If the outer stretching roller 360 is disposed upstream of the steering roller 410, as in the present embodiment, in the rotational direction of the fixing belt 310, the following merits are produced. First, the flexibility for arranging the outer stretching roller 360 can be increased. In addition, even when the steering roller 410 slants, the outer stretching roller 360 can suppress the difference between a width of one edge of the heating nip portion and a width of the other edge of the heating nip portion in the rotation axis direction. As a result, when the fixing belt 310 is heated by the heating roller 340, the unevenness in temperature of the fixing belt 310 caused by the slant of the steering roller 410 can be suppressed. As described above, in the present embodiment, the outer stretching roller 360 presses the heating roller 340 via the fixing belt 310. However, even in a configuration in which the outer stretching roller 360 presses the fixing belt 310 but does not press the heating roller 340, the unevenness in temperature of the fixing belt 310 caused by the slant of the steering roller 410 can be suppressed.

Next, the cleaning apparatus 610 will be described. As recording materials, such as paper sheets, pass through the nip portion N1, dirt such as paper dust and toner adheres to the surface of the fixing belt 310, and the dirt accumulates on the outer stretching roller 360. The dirt of the outer stretching roller 360 returns to the fixing belt 310, and adheres to the surface of a recording material and may cause image defect. If the dirt of the outer stretching roller 360 solidifies, the dirt may damage the fixing belt 310.

For preventing the above-described image defect and damage, the cleaning apparatus 610 is disposed, as illustrated in FIG. 5, for removing the paper dust and toner from the surface of the outer stretching roller 360. The cleaning apparatus 610 includes a web (web paper) 611 that serves as a cleaning member and a cleaning web, a feeding roller 613 around which the web 611 is wound, a winding roller 614, a cleaning roller 612, and a web feeding mechanism 616.

The web 611 is a sheet having a total length of 5 m and wound like a roll. Specifically, the web 611 is a nonwoven-fabric sheet made of aramid fiber of methane series. The cleaning roller 612 that serves as a pressing member is a roller that presses the web 611 toward the outer stretching roller 360. The cleaning roller 612 is urged toward the outer stretching roller 360 by a pressure spring 615, which serves as an urging member. The cleaning roller 612 of the present embodiment is formed by winding a silicone sponge around a shaft and covering the silicone sponge with a PFA tube for preventing the toner from adhering to the silicone sponge. The silicone sponge has thermal resistance and a diameter φ of 30 mm, and the PFA tube is made of fluororesin and has a thickness of about 100 μm.

The feeding roller 613 is an aluminum pipe and feeds the web 611, and the winding roller 614 is an aluminum pipe and winds the web 611. That is, for always causing a new surface of the web 611 to abut against the outer stretching roller 360, the web 611 wound around the feeding roller 613 is fed by the web feeding mechanism 616 toward a direction indicated by an arrow C, and is wound by the winding roller 614. The web 611 is fed by a predetermined length every time a recording material passes through the fixing apparatus 8B. In the present embodiment, every time two A4 sheets pass through the fixing apparatus 8, the web 611 is fed by 0.02 mm.

Preferably, the outer stretching roller 360 is made of a stainless steel, such as SUS303, that has an affinity to the melted toner, higher than that of the fixing belt 310 that has the release layer. If the outer stretching roller 360 is made of such a stainless steel, the toner and paper dust that have adhered to the surface of the fixing belt 310 can be efficiently collected.

In addition, in the present embodiment, it is preferable that the outer stretching roller 360 is disposed such that the fixing belt 310 is nipped by the outer stretching roller 360 and the heating roller 340. That is, it is preferable that the outer stretching roller 360 abuts against an area of the outer circumferential surface of the fixing belt 310 and the heating roller 340 abuts against an area of the inner circumferential surface of the fixing belt 310 that is opposite to the area of the outer circumferential surface of the fixing belt 310. In such a configuration, the heating roller 340 backs up the outer stretching roller 360, so that the outer stretching roller 360 can stably abut against the fixing belt 310. As a result, the performance of the outer stretching roller 360 to collect the toner and paper dust can be increased. As in the second embodiment, the outer stretching roller 360 may be urged toward the heating roller 340 by the spring. However, the spring may not be disposed, and the outer stretching roller 360 and the cleaning roller 612 may be urged toward the heating roller 340 by the pressure spring 615.

Next, the refreshing roller 510 will be described. The refreshing roller 510 serves as a rubbing roller, and presses the heating roller 340 at a position positioned downstream of the fixing pad 320 and upstream of the outer stretching roller 360 in the rotational direction of the fixing belt 310. In addition, the refreshing roller 510 rubs the fixing belt 310. Thus, the refreshing roller 510 is a grinding roller that grinds the outer circumferential surface of the fixing belt 310. That is, the refreshing roller 510 is a rotary member that abuts against the outer circumferential surface of the fixing belt 310 and rotates when the driving force is provided from a driving source, for stably keeping a desired state of the outer circumferential surface of the fixing belt 310. The driving source may be a motor that drives the refreshing roller 510 alone, or may be a motor that drives the heating roller 340.

By the way, if recording materials have passed through the nip portion N1 one after another, a surface property of a passage area of the fixing belt 310 may change, causing the difference in surface roughness between the passage area and the non-passage area of the fixing belt 310. In addition, there is a case in which the surface of the fixing belt 310 is cut by edge portions of a recording material (such as a paper sheet) located in the longitudinal direction of the recording material.

In this case, if another recording material whose size is larger in the longitudinal direction, than the recording materials having passed through the nip portion N1 in a sequential manner is used, image defects may be produced in the recording material. For example, unevenness in gloss may be produced in the recording material by the above-described surface roughness, and lines may be produced in the recording material by the cuts on the surface of the fixing belt 310, which are caused by the edge portions of the recording materials. Such image defects may be produced, for example, when the long edge feed is performed on an A4-size sheet after the long edge feed is successively performed on B5-size sheets.

The refreshing roller 510 is a roller for preventing such image defects, and includes a core metal, an adhesive layer formed on the core metal, and a rubbing layer formed on the adhesive layer. The core metal is made of SUS (stainless steel), and has an outer diameter of 12 mm. The rubbing layer is formed by densely sticking abrasive grains, which serve as a rubbing material, to the adhesive layer. In the present embodiment, the rubbing material used is white alundum (WA) having an average particle diameter of about 12 μm. The average particle diameter of the rubbing material may be equal to or larger than 5 μm and equal to or smaller than 20 μm, and another rubbing material other than the rubbing material of the present embodiment may be used. Examples of the rubbing material include aluminum oxide, aluminum hydroxide oxide, silicon oxide, cerium oxide, titanium oxide, zirconia, lithium silicate, silicon nitride, silicon carbide, iron oxide, chromium oxide, antimony oxide, diamond, and a mixture thereof. Thus, the rubbing layer may be formed by sticking abrasive grains enable from any one of these materials, to the adhesive layer. The particle diameter of the abrasive grains can be obtained by randomly picking up 100 or more abrasive grains by using a scanning electron microscope, S-4500, made by Hitachi, Ltd., and by calculating a number average particle diameter by using an image processing and analysis apparatus, Luzex3, made by NIRECO CORPORATION.

The refreshing roller 510 rotates at a speed different from the speed of the fixing belt 310. As described above, the refreshing roller 510 roughens the surface of the fixing belt 310 by rubbing the surface, and thereby can reduce the difference in surface roughness between the passage area and the non-passage area, and reduce the cuts on the surface of the fixing belt 310 caused by the edge portions of recording materials.

Effects of the Present Embodiment

Figure 7:
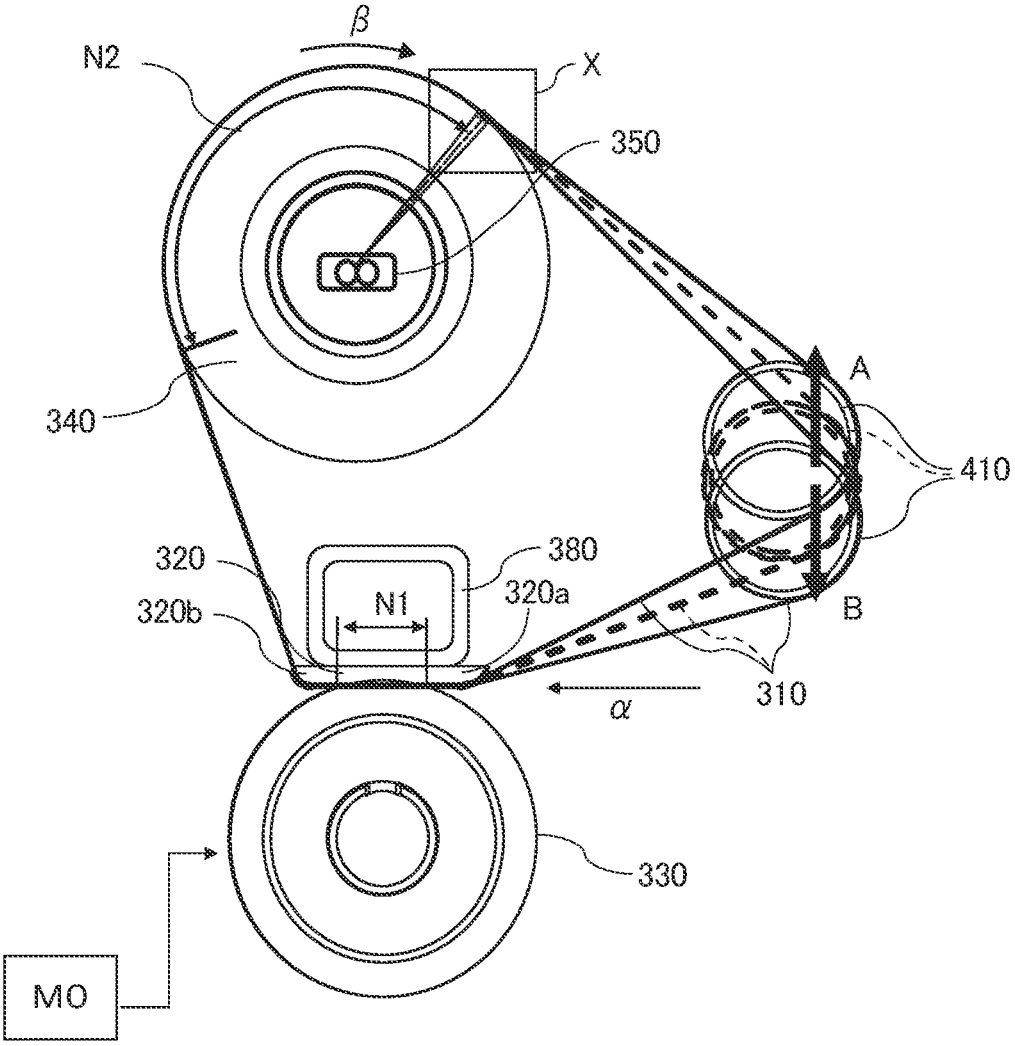
FIG. 7 is a cross-sectional view of a schematic configuration of a fixing apparatus of a comparative example that illustrates behavior of a fixing belt exhibited when the steering is performed.
Figure 8:
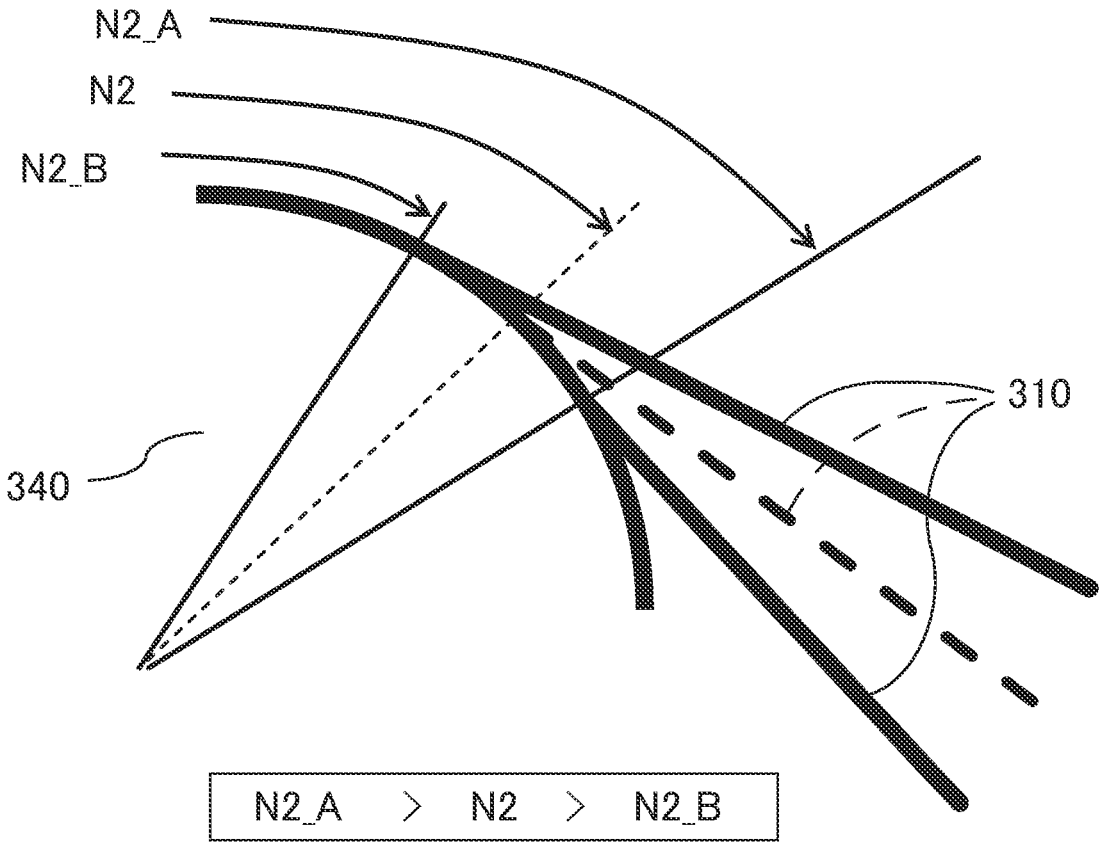
FIG. 8 is an enlarged view of an X portion of FIG. 7.

Next, effects of the above-described present embodiment will be described, compared with a comparative example in which the outer stretching roller 360 is not disposed. FIG. 7 is a cross-sectional view of a fixing apparatus of the comparative example in which the outer stretching roller 360 is not disposed. FIG. 7 illustrates a trajectory of an end portion of the fixing belt located in the longitudinal direction of the fixing belt 310, and the trajectory is produced when the steering roller 410 is steered. FIG. 8 is an enlarged schematic view that simply illustrates how the heating nip portion N2 changes when the steering roller 410 is steered.

Also in the present embodiment, as in the second embodiment, the arrangement of the outer stretching roller 360 can increase the heating nip portion N2. In addition, as illustrated in FIG. 5, the outer stretching roller 360 abuts against the fixing belt 310 at the downstream edge of the heating nip portion N2 in the rotational direction of the fixing belt 310. In addition, the steering roller 410 is disposed downstream of the outer stretching roller 360 and upstream of the nip portion N1 in the rotational direction of the fixing belt 310. In this configuration, the change of the heating nip portion N2, caused by the steering of the steering roller 410, can be suppressed.

For example, in the comparative example illustrated in FIG. 7, if one end of the steering roller 410 in the longitudinal direction is moved, by the steering, by 10 mm in a direction indicated by an arrow A of FIG. 7, and the other end of the steering roller 410 is moved by 10 mm in a direction indicated by an arrow B of FIG. 7, the change of the heating nip portion N2 caused by the steering is ±2.5%. The change of the heating nip portion N2 corresponds to the difference between a length N2_A and a length N2_B of the heating nip portion N2 in FIG. 8. The length N2_A is a maximum length of the heating nip portion N2 produced by the steering, and the length N2_B is a minimum length of the heating nip portion N2 produced by the steering.

In the present embodiment, however, even if one end of the steering roller 410 in the longitudinal direction is moved, by the steering, by 10 mm in the direction indicated by the arrow A, and the other end of the steering roller 410 is moved by 10 mm in the direction indicated by the arrow B, the change of the heating nip portion N2 caused by the steering can be almost ±0%. As a result, the heat can be stably supplied from the heating roller 340 to the fixing belt 310 in the heating nip portion N2.

In the present embodiment, the outer stretching roller 360 abuts against the fixing belt 310 at the downstream edge of the heating nip portion N2, and the steering roller 410 is disposed downstream of the outer stretching roller 360 and upstream of the nip portion N1 in the rotational direction of the fixing belt 310. In addition, a recording material that bears a toner image can be stably separated from the fixing belt 310. Note that, however, the outer stretching roller 360 may abut against the fixing belt 310 at the upstream edge of the heating nip portion N2, and the steering roller 410 may be disposed upstream of the outer stretching roller 360 and downstream of the nip portion N1 in the rotational direction of the fixing belt 310. Also in this case, the heating nip portion N2 can be stabilized. In another case, two outer stretching rollers 360 may be used, and one may abut against the fixing belt 310 at a position positioned upstream edge of the healing nip portion N2 in the rotational direction of the fixing belt 310, and the other may abut against the fixing belt 310 at a position positioned downstream edge of the heating nip portion N2 in the rotational direction of the fixing belt 310.

Fourth Embodiment

Figure 9:
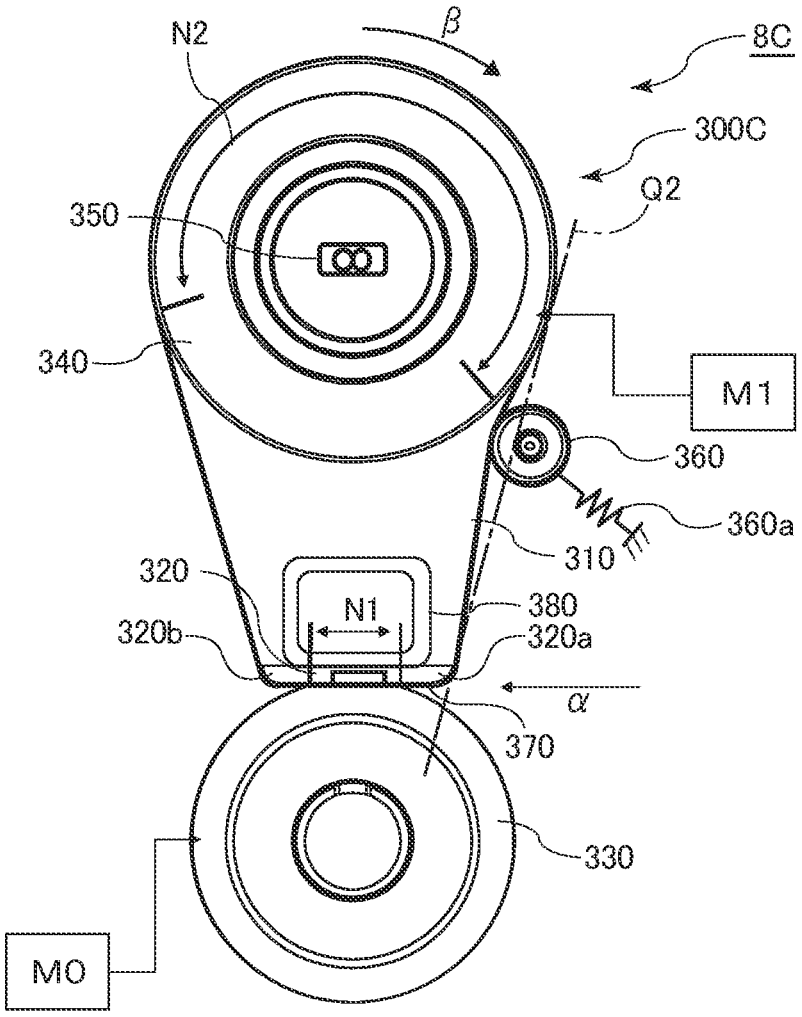
FIG. 9 is a cross-sectional view of a schematic configuration of a fixing apparatus of a fourth embodiment.

Next, a fourth embodiment will be described with reference to FIG. 9. In the above-described second embodiment, the outer stretching roller 360 is disposed at the downstream edge of the heating nip portion N2. In the present embodiment, however, the outer stretching roller 360 is disposed at a position located downstream of the heating nip portion N2. The other configuration and operations are the same as those of the above-described second embodiment. Thus, a component identical to a component of the second embodiment is given an identical symbol, and duplicated description and illustration will be omitted or simplified, and features different from the second embodiment will be mainly described below.

In a heating unit 300C of a fixing apparatus 8C of the present embodiment, the outer stretching roller 360 is disposed at a position located downstream of the heating roller 340 in the rotational direction of the fixing belt 310. That is, the outer stretching roller 360 abuts against the outer circumferential surface of the fixing belt 310 at a position located downstream of an area in which the fixing belt 310 abuts against the heating roller 340 and upstream of the fixing pad 320 in the rotational direction (indicated by an arrow β) of the fixing belt 310. In this arrangement, the fixing belt 310 is positioned closer to the healing roller (rotary heating member) 340 than the fixing belt 310 that would be stretched between the heating roller 340 and the fixing pad 320 if the outer stretching roller 360 were not disposed. The fixing pad 320 is a predetermined one of the plurality of stretching members, and located downstream of the heating roller 340 in the rotational direction of the fixing belt 310.

In other words, the outer stretching roller 360 abuts against the outer circumferential surface of the fixing belt 310 at a position located downstream of the downstream edge of the heating nip portion N2, which is the area in which the fixing belt 310 abuts against the heating roller 340, in the rotational direction of the fixing belt 310. In addition, the outer stretching roller 360 is positioned at a position at which the outer stretching roller 360 pushes the fixing belt 310 toward the heating roller 340. That is, the outer stretching roller 360 is positioned at a position at which the outer stretching roller 360 pushes the fixing belt 310 from a tangent Q2 of the heating roller 340 toward the heating roller 340. The tangent Q2 of the heating roller 340 is a line that touches the upstream edge of the fixing pad 320 located in the conveyance direction. The area in which the fixing belt 310 abuts against the heating roller 340 is the heating nip portion N2.

Also in the present embodiment, the outer stretching roller 360 is urged toward the heating roller 340 by the pressure spring 360*a*, which serves as an urging member. The outer stretching roller 360 abuts against the fixing belt 310 in a direction extending from a position located downstream of the heating roller 340 in the rotational direction of the fixing belt 310, toward the heating roller 340, for moving the fixing belt 310 along the curved shape portion 320*a* of the fixing pad 320.

In the present embodiment, as described above, the outer stretching roller 360 is disposed at a position located downstream of the heating nip portion N2 in the rotational direction of the fixing belt 310, for increasing the area of the heating nip portion N2 with respect to the area of the heating nip portion N2 obtained when the outer stretching roller 360 is not disposed. Thus, as in the second embodiment, the amount of heat supplied to the fixing belt 310 can be secured while the power consumption is suppressed. In addition, the configuration of the present embodiment is hardly affected by the space in which the fixing apparatus is disposed. Note that although the outer stretching roller 360 is disposed at a position located downstream of the heating nip portion N2 in the present embodiment, the outer stretching roller 360 may be disposed at a position located upstream of the heating nip portion N2. In another case, two outer stretching rollers 360 may be used, and one may abut against the heating roller 340 at a position located upstream of the heating nip portion N2 in the rotational direction and the other may abut against the heating roller 340 at a position located downstream of the heating nip portion N2 in the rotational direction.

OTHER EMBODIMENTS

The heating roller 340 may not have the motor M1, which serves as a heating-roller driving source. Instead, the heating roller 340 may be rotated by the rotation of the fixing belt 310, which is rotated by the motor M0 that drives the pressure roller 330 and serves as a pressure-roller driving source.

In the above-described embodiments, the outer stretching roller 360 is urged toward the heating roller 340 by the pressure spring 360*a*. However, the outer stretching roller 360 may be fixed to a position at which the outer stretching roller 360 pushes the fixing belt 310 toward the heating roller 340 as described above.

In addition, in the above-described embodiments, the halogen heater is disposed in the rotating heating roller 340 (an assistance driving roller), as a heating source that heats the fixing belt. However, the heating source may be disposed not in the assistance driving roller, but in another stretching member, such as the steeling roller. The healing source may be disposed in the pad member. For example, a plate-like heat-generating member may be disposed in a surface of the pad member on the fixing belt side. In addition, the fixing belt may be heated through electromagnetic induction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-059008, filed Mar. 27, 2020 which is hereby incorporated by reference herein in its entirety.

What is claimed is:

1. A fixing apparatus comprising:

a belt configured to fix an image onto a recording material;

a plurality of stretching members configured to be in contact with an inner surface of the belt and stretch the belt, the plurality of stretching members comprising:

a pad member;

a heating roller in which a heater is disposed and which heats the belt; and a steering roller configured to adjust a position of the belt in a width direction, by slanting, the heating roller and the steering roller being disposed adjacent to each other in the plurality of stretching members;

a pressure member configured to press the pad member via the belt and rotate, the pressure member and the belt being configured to form a nip portion in cooperation with each other, the nip portion being a portion in which the recording material is nipped and conveyed; and an outer stretching roller disposed between the heating roller and the steering roller and configured to press an outer surface of the belt, wherein, in a cross section orthogonal to a rotation axis of the pressure member, a surface between the heating roller and the steering roller of the belt in a state where the belt is pushed by the outer stretching roller is located inside that of the belt in a state where the outer stretching roller is removed, and wherein the surface between the heating roller and the steering roller of the belt in the state where the belt is pushed by the outer stretching roller is located inside that of the belt in a state where the outer stretching roller is removed and the steering roller slants at a maximum angle.

2. The fixing apparatus according to claim 1, wherein the heating roller is disposed downstream of the pad member and upstream of the steering roller in a rotational direction of the belt.

3. The fixing apparatus according to claim 1, wherein a rotation center of the heating roller is located above a rotation center of the steering roller in a vertical direction.

4. The fixing apparatus according to claim 1, wherein the outer stretching roller is a metal roller.

5. The fixing apparatus according to claim 4, further comprising:

a cleaning web configured to clean the metal roller; and a pressing member configured to press the cleaning web against the metal roller.

6. The fixing apparatus according to claim 1, further comprising a rubbing roller configured to rub the belt, wherein the rubbing roller is configured to press the heating roller at a position located downstream of the pad member and upstream of the outer stretching roller in a rotational direction of the belt.

7. The fixing apparatus according to claim 1, wherein a rotation center of the heating roller is separated more from the nip portion than a rotation center of the steering roller in a direction orthogonal to a conveyance direction of the recording material.

8. The fixing apparatus according to claim 1, further comprising an urging member configured to urge the steering roller such that the steering roller provides tension to the belt.

9. The fixing apparatus according to claim 1, wherein the heating roller is a driving roller configured to drive the belt.

10. The fixing apparatus according to claim 1, further comprising a driving source configured to provide driving force to the pressure member.

11. The fixing apparatus according to claim 1, wherein the outer stretching roller is configured to nip the belt with the heating roller.

* * * * *